United States Patent [19]

Magnus

[11] 4,135,732

[45] Jan. 23, 1979

[54] SKIS

[75] Inventor: Hans P. Magnus, Hop, Norway

[73] Assignee: Magnus & Co. A/S, Nesttun, Norway

[21] Appl. No.: 772,045

[22] Filed: Feb. 25, 1977

[30] Foreign Application Priority Data

Mar. 11, 1976 [NO] Norway ..... 760845

[51] Int. Cl.[2] ..... A63C 5/12

[52] U.S. Cl. ..... 280/610

[58] Field of Search ..... 280/610

[56] References Cited

U.S. PATENT DOCUMENTS

| | | | |
|---|---|---|---|
| 2,695,178 | 11/1954 | Rheinfrank, Jr. | 280/610 |
| 3,635,483 | 1/1972 | Bariball et al. | 280/610 |

FOREIGN PATENT DOCUMENTS

| | | | |
|---|---|---|---|
| 2128826 | 12/1972 | Fed. Rep. of Germany | 280/610 |
| 87350 | 6/1966 | France | 280/610 |
| 1382829 | 11/1964 | France | 280/610 |
| 436928 | 6/1948 | Italy | 280/610 |

*Primary Examiner*—Joseph F. Peters, Jr.
*Assistant Examiner*—Milton L. Smith
*Attorney, Agent, or Firm*—Ladas, Parry, Von Gehr, Goldsmith & Deschamps

[57] ABSTRACT

Ski with a core of light-weight material, preferably of specific gravity from 0.1 to 0.25, and an outer sheathing composed of a reinforced synthetic plastics material. The core has an internal reinforcement of relatively narrow ribs of unreinforced plastics material with a wall thickness less than 1.5 mm and preferably about 0.5 mm extending substantially at right angles to its upper side and/or its under side directly unified with the plastics material of the sheathing.

7 Claims, 4 Drawing Figures

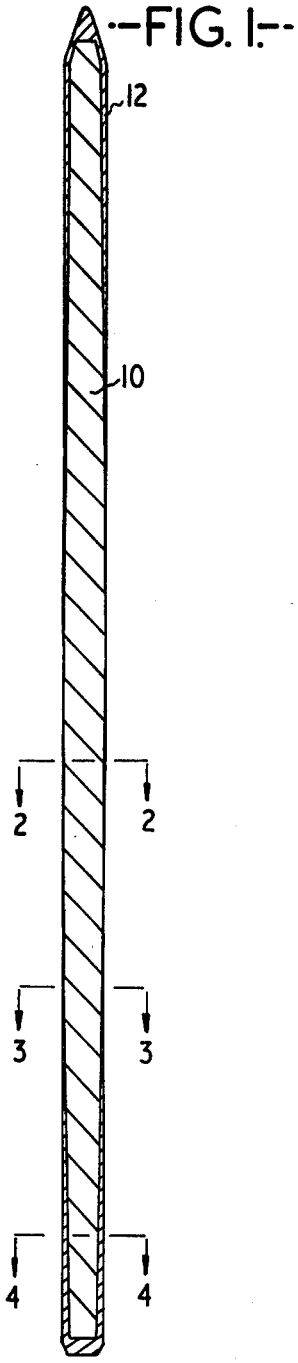
--FIG. 1.--
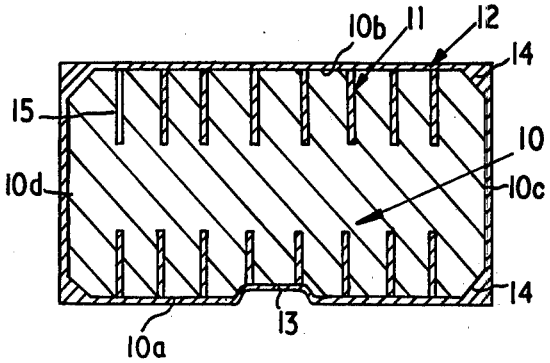
--FIG. 2.--
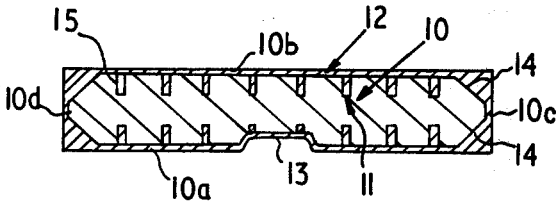
--FIG. 3.--
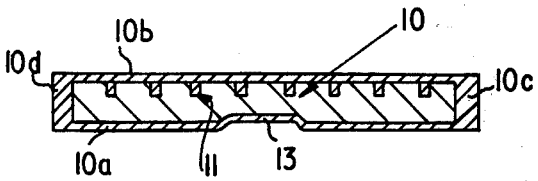
--FIG. 4.--

SKIS

This invention relates to skis.

In recent times, attempts have been made to produce skis having the lowest possible weight, while exhibiting necessary rigidity and strength, together with other diverse properties which are desirable or more or less necessary. A particularly simple construction consists of a core of light-weight material surrounded by an outer sheathing of a reinforced synthetic plastic materials.

By utilizing an outer sheathing of a glass fiber-reinforced synthetic plastic material, great tensile strength is obtained even with a relatively thin-walled outer sheathing. On flexing a ski one attains, with such a solution, sufficient strength and rigidity on the stretching side of the flexure of the outer sheathing, while the outer sheathing on the pressure side of the flexure has a tendency to be closed together in corrugated form. The tendency to form corrugations in the outer sheathing on the pressure side of the ski during flexing involves the occurrence of disadvantageous shearing forces in the core and the delamination of the core at a level some distance within the outer sheathing. The result is that a break occurs in the ski.

A particular objective of the present invention is to avoid the deformation and afore-mentioned breaking of the ski.

The afore-mentioned problem has hitherto been partly solved by increasing the contact surface between the outer sheathing and the core by incorporating a rib formed reinforcement therebetween. Such rib formed reinforcement in one known embodiment thereof consists of reinforced plastics material, i.e. of glass fiber rovings impregnated with plastics material, which has been filled into narrow grooves in said core. However, in order to enable said impregnated glass fiber rovings to be filled in a technically acceptable manner into said grooves, the thickness of said groove has to exceed 2 mm. In practice, the problems of filling said impregnated glass fiber rovings into said grooves in a technically acceptable manner will increase the smaller the thickness of said groove is made. On the other hand, internal tensions in the plastics material increase with the thickness of the rib formed reinforcement.

The aim of the invention is to reduce the internal tensions in the rib formed reinforcement as much as possible without reducing the contact surface betwen the core and the outer sheathing in the ski.

According to the present invention a ski comprises a core of light-weight material and an outer sheathing composed of a reinforced synthetic plastics material, said core having an internal reinforcement of relatively narrow ribs extending substantially at right angles to at least one of its upper side and its under side and directly unified with said plastics material of said sheathing, wherein said ribs consist of unreinforced synthetic plastics material filled in narrow grooves formed in said core and said ribs having a wall thickness less than 1.5 mm and preferably about 0.5 mm.

According to the present invention it is thus possible by omitting glass fiber rovings in said ribs to reduce the wall thickness of each rib and to reduce accordingly internal tension in the plastics material of each rib. In practice, it is found that sufficient strength in the ribs is achieved by the plastics material per se to avoid delaminating of the core and the outer sheathing. By omitting glass fiber rovings in said ribs the thickness of each rib can easily be less than 1.5 mm. In practice, a rib thickness of about 0.5 mm is preferred. This means that the total weight of the ski can be reduced partly by omitting glass fiber rovings in each rib and partly by reducing the amount of plastics material in each rib. In addition, the process of producing said ribs is substantially facilitated by completely omitting the use of glass fiber rovings in said ribs. The result is a cheaper ski having a reduced total weight without substantially involving the strength of the ski.

Desirably, the ribs have a depth of at least 1 mm, preferably 2–7 mm, with the greatest depth at the center of the ski and the least depth at the ends of the ski, and have a mutual clearance of up to 20 mm, preferably approximately 5 mm.

In order that the invention can be more clearly understood, a convenient embodiment thereof will now be described, by way of example, with reference to the accompanying drawings in which:

FIG. 1 is a section of a ski taken at a level just within the outer sheathing thereof.

FIG. 2 is a cross-section along the line 2 — 2 of FIG. 1.

FIG. 3 is a cross-section along the line 3 — 3 of FIG. 1, and

FIG. 4 is a cross-section along the line 4 — 4 of FIG. 1.

Referring to the drawings, a ski is composed of a core 10 with associated rib-shaped reinforcement 11 and a surrounding outer sheathing 12.

The core 10 is made in one piece by molding polyurethane foam material having a specific gravity of from 0.5 to 0.2.

Alternatively, there can be employed foam material composed of acrylimide or another suitable synthetic plastics material or balsa wood or another similar light-weight material. While a light-weight material having a specific gravity of from 0.1 to 0.25 is preferred, materials having a somewhat smaller or somewhat greater specific gravity can also be considered. The core can be formed by molding or cutting out.

The core 10 is produced with a guide groove 13 on the under side **10*a* of the core to form the ski's guide groove and is provided with chamfered edges 14. Furthermore, slots or narrow grooves 15 are formed by means of a cutting tool in the under side 10*a* and upper side 10*b* of the core, at right angles to the respective side and directly facing the grooves on the opposite side. As is evident from FIGS. 2 and 3, the grooves 15** have a depth somewhat less than half the thickness of the core and the depth of the grooves decreases from the center of the ski towards the ends of the skis where the core has a correspondingly smaller thickness. In practice, it has been found that a groove depth of approximately 7 mm is satisfactory at the center of the ski, while a depth of 1 - 2 mm is appropriate at the ends of the core.

It is also possible to discard the grooves at the ends of the core, on the one or both sides. The grooves on the under side of the core can, if desired, be situated between the grooves on the upper side of the core so that, for example, the grooves overlap one another in the center of the ski.

The grooves having a thickness of less than 1.5 mm and preferably about 0.5 mm are filled with unreinforced plastic in the form of unhardened epoxy resin. This unhardened plastic enters into direct combination with an unhardened glass fiber reinforced plastic which forms the outer sheathing 12 and is hardened together with the latter so that there is formed in the grooves 15, the rib-shaped reinforcement 11 directly unified with the unhardened outer sheathing 12.

The outer sheathing 12 is formed from epoxy-impregnated glass fiber rovings which extend in the longitudinal direction of the ski or on the under side 10*a* and upper side 10*b* of the ski together with the edge sides 10*c* and 10*d* of the ski. It is evident from FIG. 1 that the core is terminated, in a manner known per se, at a distance from the front and rear ends of the ski where the material of the ski mainly consists of epoxy-impregnated glass fiber rovings.

The edges are a weak point on skis with a relatively porous core and with a relatively thin sheathing. The edges are, therefore, strengthened both on the upper side and under side of the ski in that the edges of the core are chamfered as shown at 14. At the ends of the ski where the core is so thin (2 – 3 mm) that there is not space for the chamfered edges, the core is instead made 3 – 4 mm narrower than the finished ski so that the ski with the narrow side edges receives an extra thick edge layer which is filled with reinforced synthetic plastics material.

What is claimed is:

1. Ski comprising a core of light-weight material and an outer sheathing composed of a reinforced synthetic plastics material, said core having an internal reinforcement of relatively narrow ribs extending substantially at right angles to at least one of its upper side and its under side, and directly unified with said plastics material of said sheathing, wherein said ribs consist of unreinforced synthetic plastics material being filled in narrow grooves formed in said core and said ribs having a wall thickness less than 1.5 mm and preferably about 0.5 mm, and wherein corner edges of the core over substantially the whole length of the ski are chamfered enabling said edges to be strengthened with a thickness of about 2 – 3 mm of said reinforced synthetic plastics material of said sheathing, said core at the ends of said ski being narrower than at the middle of the ski to permit said reinforced synthetic plastics material of said sheathing to form a substitute protective layer for edges of said ski at said ends.

2. Ski according to claim 1, wherein said outer sheathing and said ribs share the same synthetic plastics material.

3. Ski according to claim 1, wherein said ribs have a depth of at least 1 mm with a maximum depth at the centre of the ski and a minimum depth at the ends of the ski and a mutual spacing of up to 20 mm.

4. Ski according to claim 3, wherein said depth is from 2 to 7 mm and said mutual spacing is approximately 5 mm.

5. Ski according to claim 1, wherein said light-weight material has a specific gravity of from 0.1 to 0.25.

6. Ski according to claim 5, wherein said light-weight material is balsa wood.

7. Ski according to claim 5, wherein said light-weight material is a synthetic plastics foam material selected from the group consisting of acrylimide and polyurethane foam materials.

* * * * *